US012467212B1

(12) United States Patent
Smith

(10) Patent No.: US 12,467,212 B1
(45) Date of Patent: Nov. 11, 2025

(54) GROUND-LEVELING FORM

(71) Applicant: Rich Smith, Clearfield, PA (US)

(72) Inventor: Rich Smith, Clearfield, PA (US)

( * ) Notice: Subject to any disclaimer, the term of this patent is extended or adjusted under 35 U.S.C. 154(b) by 33 days.

(21) Appl. No.: 18/413,134

(22) Filed: Jan. 16, 2024

(51) Int. Cl.
*E01C 19/50* (2006.01)

(52) U.S. Cl.
CPC ..... *E01C 19/506* (2013.01)

(58) Field of Classification Search
CPC ..... E04F 13/00; E04G 17/14; E04G 21/1841; E04G 21/18; E04G 21/1816; E04G 21/1825; E04G 21/1833; E04G 21/1883; E01C 19/502; E01C 19/504; E01C 19/506; E01C 15/00; E01C 9/001; E01C 23/05; E02D 27/013; E02D 27/02; E02D 27/50; E03D 2250/0023; E03D 2250/0007
See application file for complete search history.

(56) References Cited

U.S. PATENT DOCUMENTS 683,081 A 9/1901 Sullivan
1,202,269 A * 10/1916 Cramer ..... E01C 19/506 249/4
1,700,798 A * 2/1929 Heltzel ..... E01C 19/502 249/6
4,451,022 A * 5/1984 Sauger ..... E04G 13/00 249/4
4,533,112 A * 8/1985 Santos, Jr ..... E01C 19/506 249/207
5,332,191 A * 7/1994 Nolan ..... B28B 7/02 249/4
5,419,055 A * 5/1995 Meadows ..... E04G 21/1808 33/518
6,021,994 A * 2/2000 Shartzer, Jr. ..... E04G 13/00 249/7
7,004,442 B2 * 2/2006 Braungardt ..... B28B 7/0029 425/432
7,290,749 B1 * 11/2007 Jessop ..... E04G 13/00 249/34
9,731,433 B1 * 8/2017 Shumaker ..... B28B 7/0029
9,903,111 B1 * 2/2018 Nir ..... E04G 21/1841
10,323,424 B2 6/2019 Young
D932,528 S 10/2021 Huang
2003/0009897 A1 * 1/2003 Gonzales ..... E01C 19/506 33/645
2003/0042393 A1 * 3/2003 Osborn ..... E04G 17/14 249/13
2003/0111585 A1 * 6/2003 Hufnagel ..... E01C 19/502 249/1

(Continued)

FOREIGN PATENT DOCUMENTS

CA 2350370 11/2008
WO WO-2007093794 A1 * 8/2007 ..... E04G 21/1808

*Primary Examiner* — Kyle J. Walraed-Sullivan

(57) ABSTRACT

The ground leveling form is a mechanical structure. The ground leveling form is for use in building an earthwork. The earthwork is an embankment that is often referred to as a retaining wall. The ground leveling form is a soil leveling structure that forms the footing of the retaining wall. The ground leveling form incorporates a perimeter frame, a plurality of angle plates, a plurality of anchor stakes, and a plurality of anchor guides. The plurality of anchor stakes attach to the perimeter frame. The plurality of anchor guides attach to the perimeter frame. The plurality of anchor stakes anchors the ground leveling form to the ground.

10 Claims, 4 Drawing Sheets

(56) References Cited

U.S. PATENT DOCUMENTS

| | | | | |
|---|---|---|---|---|
| 2003/0146365 | A1* | 8/2003 | Miller | E04G 17/04 249/2 |
| 2004/0093817 | A1* | 5/2004 | Pujol Barcons | E04G 17/002 52/294 |
| 2006/0070313 | A1* | 4/2006 | Moblo | E04G 17/14 52/155 |
| 2006/0260263 | A1* | 11/2006 | Cannata | E04G 13/062 52/846 |
| 2007/0001089 | A1* | 1/2007 | Moblo | E04G 13/00 249/208 |
| 2008/0022618 | A1* | 1/2008 | Jessop | E04G 17/14 52/375 |
| 2010/0327145 | A1* | 12/2010 | Savard | B29C 33/48 264/219 |
| 2011/0277330 | A1* | 11/2011 | Dumas | E04G 1/04 33/301 |
| 2017/0089081 | A1* | 3/2017 | Byfield | E04G 17/0652 |
| 2018/0073260 | A1* | 3/2018 | Middleton | E04G 21/1833 |
| 2019/0032347 | A1* | 1/2019 | Young | E04G 13/00 |
| 2020/0378132 | A1* | 12/2020 | Hatzinikolas | E04F 13/0805 |
| 2022/0412106 | A1 | 12/2022 | Leone | |

* cited by examiner

GROUND-LEVELING FORM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of removable supporting and anchoring means. (E01C19/506)

Summary of Invention

The ground leveling form is a mechanical structure. The ground leveling form is configured for use in building an earthwork. The earthwork is an embankment that is often referred to as a retaining wall. The ground leveling form is a soil leveling structure that forms the footing of the retaining wall. The ground leveling form comprises a perimeter frame, a plurality of angle plates, a plurality of anchor stakes, and a plurality of anchor guides. The plurality of anchor stakes attach to the perimeter frame. The plurality of anchor guides attach to the perimeter frame. The plurality of anchor stakes anchors the ground leveling form to the ground.

These together with additional objects, features and advantages of the ground leveling form will be readily apparent to those of ordinary skill in the art upon reading the following detailed description of the presently preferred, but nonetheless illustrative, embodiments when taken in conjunction with the accompanying drawings.

In this respect, before explaining the current embodiments of the ground leveling form in detail, it is to be understood that the ground leveling form is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ground leveling form.

It is therefore important that the claims be regarded as including such equivalent construction insofar as they do not depart from the spirit and scope of the ground leveling form. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
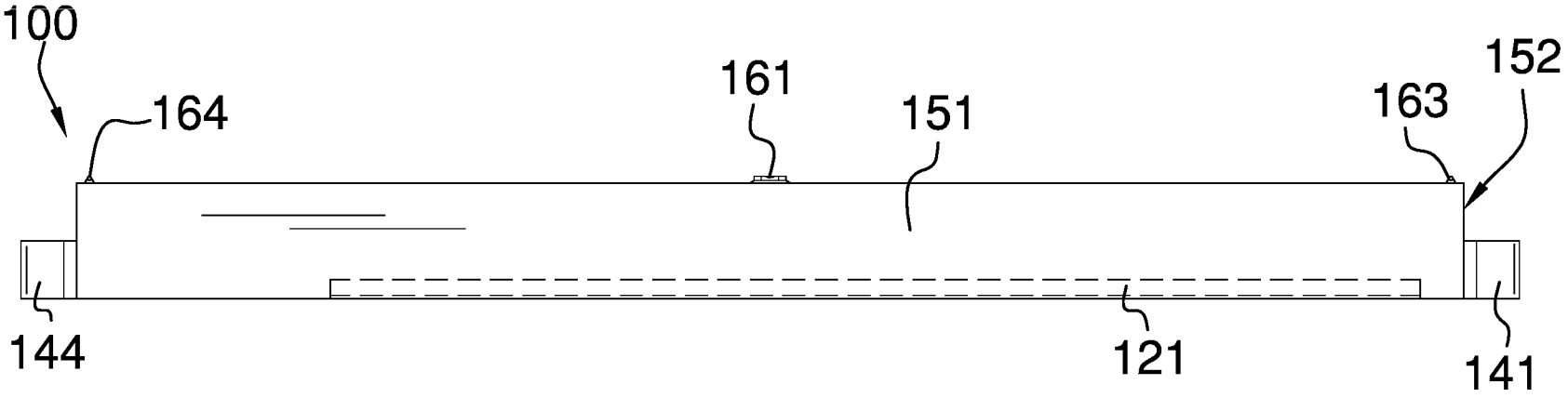
FIG. 1 is an anterior view of an embodiment of the disclosure.
Figure 2:
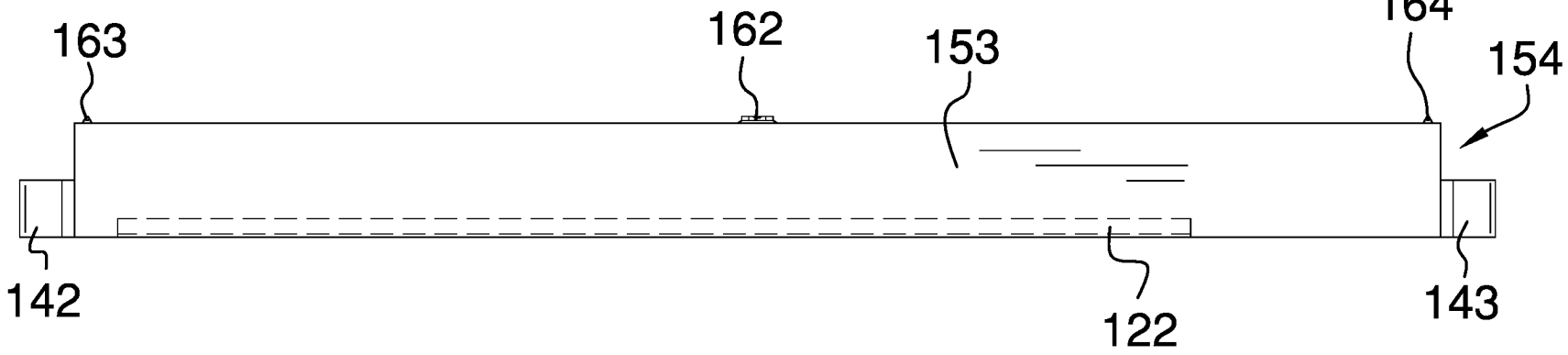
FIG. 2 is a posterior view of an embodiment of the disclosure.
Figure 3:
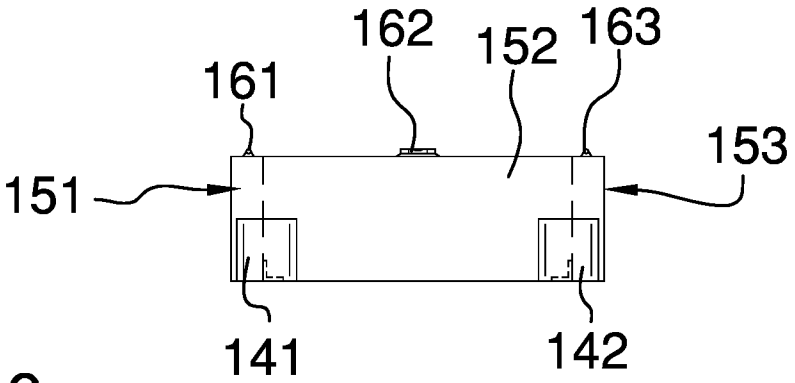
FIG. 3 is a side view of an embodiment of the disclosure.
Figure 4:
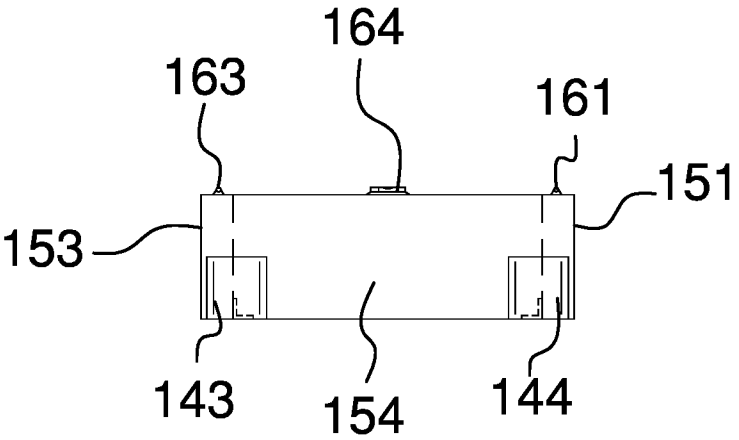
FIG. 4 is a reverse side view of an embodiment of the disclosure.
Figure 5:
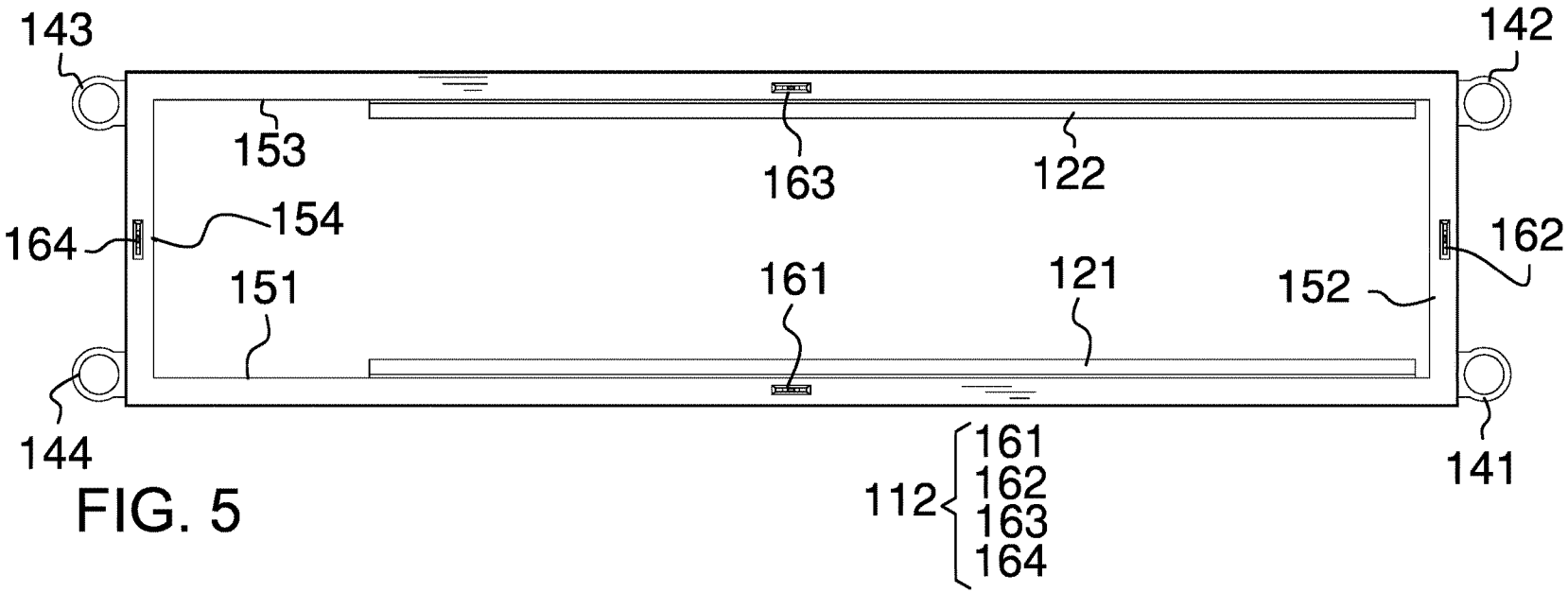
FIG. 5 is a superior view of an embodiment of the disclosure.
Figure 6:
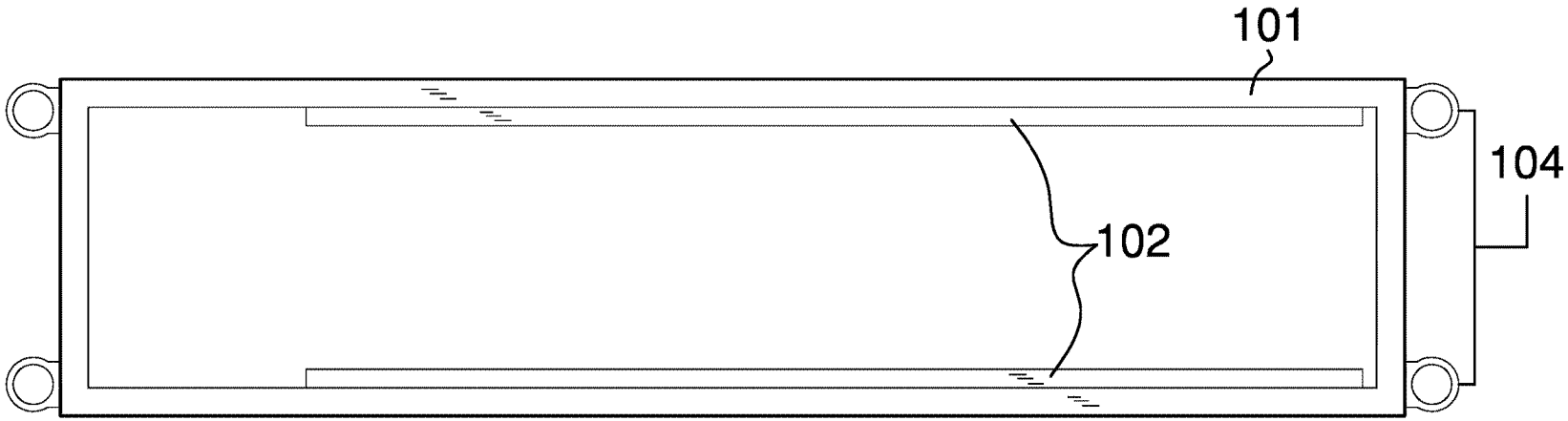
FIG. 6 is an inferior view of an embodiment of the disclosure.
Figure 7:
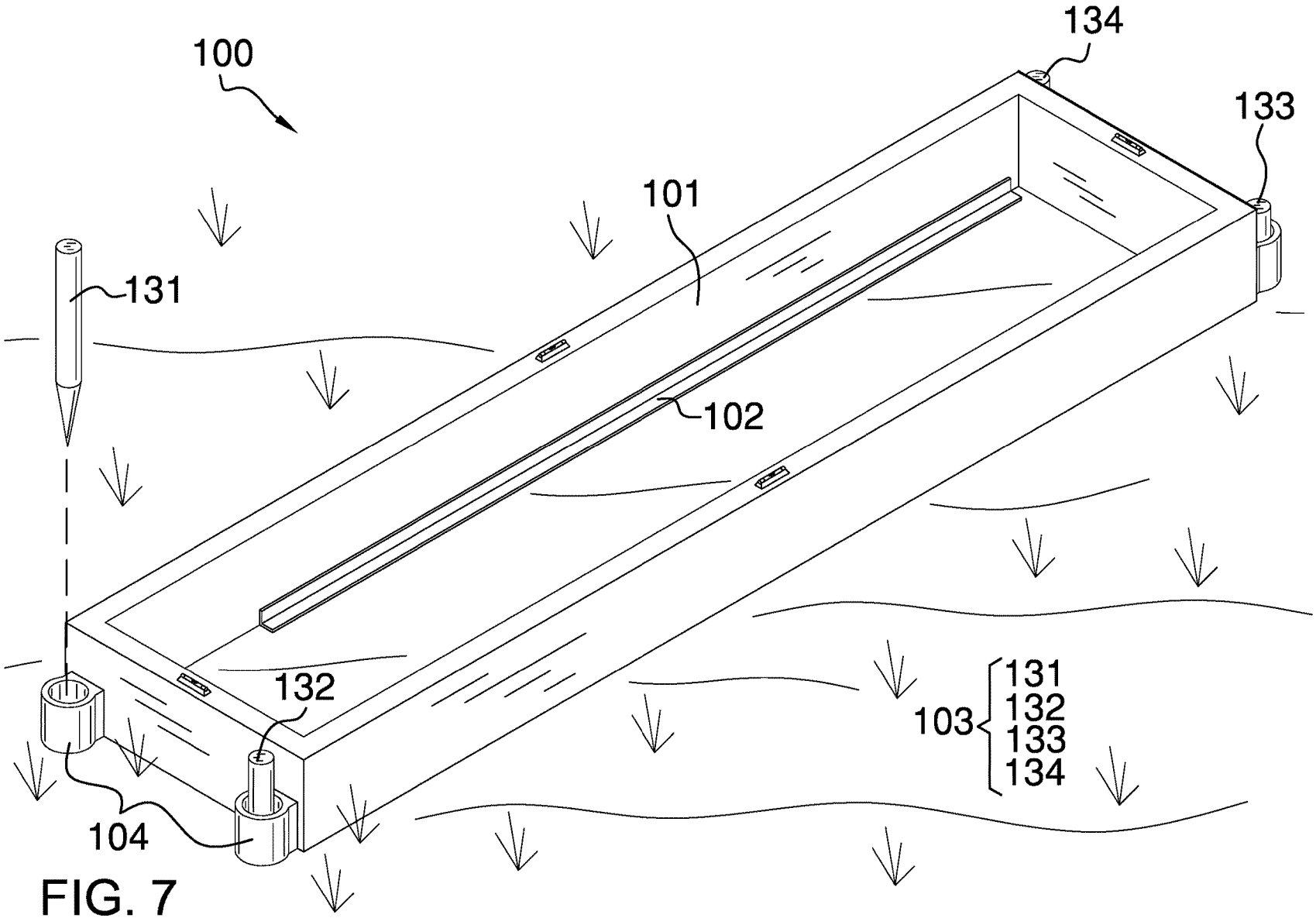
FIG. 7 is an in-use view of an embodiment of the disclosure.

Detailed reference will now be made to one or more potential embodiments of the disclosure, which are illustrated in FIGS. 1 through 7.

The ground leveling form 100 (hereinafter invention) is a mechanical structure. The invention 100 is configured for use in building an earthwork. The earthwork is an embankment that is often referred to as a retaining wall. The invention 100 is a soil leveling structure that forms the footing of the retaining wall. The invention 100 comprises a perimeter frame 101, a plurality of angle plates 102, a plurality of anchor stakes 103, and a plurality of anchor guides 104. The plurality of anchor stakes 103 attach to the perimeter frame 101. The plurality of anchor guides 104 attach to the perimeter frame 101. The plurality of anchor stakes 103 anchors the invention 100 to the ground.

The perimeter frame 101 is a jig. The perimeter frame 101 is a ring shaped structure. The perimeter frame 101 has a rectangular shape. The perimeter frame 101 is configured for use in forming a level footing. The perimeter frame 101 forms an openwork structure that receives the plurality of bricks that forms the footing. The plurality of bricks are contained within the characteristic aperture of the ring structure of the perimeter frame 101. The perimeter frame 101 holds the plurality of bricks in a roughly fixed position that allows the elevation of each brick selected from the plurality of bricks to be individually adjusted to form a level footing surface. The perimeter frame 101 is removed after the construction of the footing is completed. The perimeter frame 101 comprises a plurality of perimeter plates 111 and a plurality of leveling devices 112.

The plurality of perimeter plates 111 forms the perimeter of the ring structure of the perimeter frame 101. The plurality of perimeter plates 111 are assembled to form a rectangular shape. Each perimeter plate selected from the plurality of perimeter plates 111 is a rigid structure. Each selected perimeter plate is a disk shaped structure. Each selected perimeter plate is positioned such that the minor axis of the selected perimeter plate is parallel to the force of gravity. Each selected perimeter plate is positioned such that the major axis of the selected perimeter plate is perpendicular to the force of gravity. The plurality of perimeter plates 111 comprises a first perimeter plate 151, a second perimeter plate 152, a third perimeter plate 153, and a fourth perimeter plate 154.

The first perimeter plate 151 is a disk shaped structure. The first perimeter plate 151 is a rigid structure. The first perimeter plate 151 forms a brink with the second perimeter plate 152. The first perimeter plate 151 is the perimeter plate selected from the plurality of perimeter plates 111 with the major axis that has the greatest span of length. The first perimeter plate 151 attaches to the second perimeter plate 152 such that the major axis of the first perimeter plate 151 is perpendicular to the major axis of the second perimeter plate 152.

The second perimeter plate 152 is a disk shaped structure. The second perimeter plate 152 is a rigid structure. The second perimeter plate 152 forms a brink with the third perimeter plate 153. The second perimeter plate 152 is the perimeter plate selected from the plurality of perimeter plates 111 with the major axis that has the least span of length. The second perimeter plate 152 attaches to the third perimeter plate 153 such that the major axis of the second perimeter plate 152 is perpendicular to the major axis of the third perimeter plate 153.

The third perimeter plate 153 is a disk shaped structure. The third perimeter plate 153 is a rigid structure. The third perimeter plate 153 forms a brink with the fourth perimeter plate 154. The third perimeter plate 153 is the perimeter plate selected from the plurality of perimeter plates 111 that is distal from the first perimeter plate 151. The third perimeter plate 153 attaches to the fourth perimeter plate 154 such that the major axis of the third perimeter plate 153 is perpendicular to the major axis of the fourth perimeter plate 154.

The fourth perimeter plate 154 is a disk shaped structure. The fourth perimeter plate 154 is a rigid structure. The fourth perimeter plate 154 forms a brink with the first perimeter plate 151. The fourth perimeter plate 154 is the perimeter plate selected from the plurality of perimeter plates 111 that is distal from the second perimeter plate 152. The fourth perimeter plate 154 attaches to the first perimeter plate 151 such that the major axis of the fourth perimeter plate 154 is perpendicular to the major axis of the first perimeter plate 151.

Each leveling device selected from the plurality of leveling devices 112 is a leveling device. The leveling device is defined elsewhere in this disclosure. Each selected leveling device is associated with a perimeter plate selected from the plurality of perimeter plates 111. Each selected leveling device mounts on its associated selected perimeter plate such that the selected leveling device measures the cant between the major axis of the selected perimeter plate and the direction of the force of gravity. Each selected leveling device ensures that the perimeter frame 101 can form a reference plane that ensures that the footing surface formed by the plurality of bricks is level. The plurality of leveling devices 112 comprises a first leveling device 161, a second leveling device 162, a third leveling device 163, and a fourth leveling device 164.

The first leveling device 161 is the leveling device selected from the plurality of leveling devices 112 that measures the cant between the force of gravity and the major axis of the first perimeter plate 151. The first leveling device 161 mounts on the superior lateral face of the disk structure of the first perimeter plate 151.

The second leveling device 162 is the leveling device selected from the plurality of leveling devices 112 that measures the cant between the force of gravity and the major axis of the second perimeter plate 152. The second leveling device 162 mounts on the superior lateral face of the disk structure of the second perimeter plate 152.

The third leveling device 163 is the leveling device selected from the plurality of leveling devices 112 that measures the cant between the force of gravity and the major axis of the third perimeter plate 153. The third leveling device 163 mounts on the superior lateral face of the disk structure of the third perimeter plate 153.

The fourth leveling device 164 is the leveling device selected from the plurality of leveling devices 112 that measures the cant between the force of gravity and the major axis of the fourth perimeter plate 154. The fourth leveling device 164 mounts on the superior lateral face of the disk structure of the fourth perimeter plate 154.

The plurality of angle plates 102 forms a bracing structure. The plurality of angle plates 102 braces the plurality of bricks within the characteristic aperture. The plurality of angle plates 102 holds the plurality of bricks in their final position after the elevation of the plurality of bricks have been set. Each angle plate selected from the plurality of angle plates 102 attaches to a perimeter plate selected from the plurality of perimeter plates 111. Each selected angle plate attaches to perimeter plate selected from the group consisting of: a) the first perimeter plate 151; and, b) the third perimeter plate 153. The plurality of angle plates 102 comprises a first angle plate 121 and a second angle plate 122.

The first angle plate 121 is the angle plate selected from the plurality of angle plates 102 that attaches to the first perimeter plate 151. The first angle plate 121 attaches to the interior lateral face of the first perimeter plate 151. The first angle plate 121 attaches to the first perimeter plate 151 such that the line of the bend formed in the first angle plate 121 is parallel to the major axis of the first perimeter plate 151.

The second angle plate 122 is the angle plate selected from the plurality of angle plates 102 that attaches to the second perimeter plate 152. The second angle plate 122 attaches to the interior lateral face of the second perimeter plate 152. The second angle plate 122 attaches to the second perimeter plate 152 such that the line of the bend formed in the second angle plate 122 is parallel to the major axis of the second perimeter plate 152.

The plurality of anchor guides 104 form the structures that secure the plurality of anchor stakes 103 to the perimeter frame 101. Each anchor guide selected from the plurality of anchor guides 104 is a prism shaped structure. Each selected anchor guide is a hollow structure. Each selected anchor guide is a tubular structure. The span of the length of the inner dimension of each selected anchor guide is greater that the span of the length of the outer dimension of any anchor stake selected from the plurality of anchor stakes 103. Each selected anchor stake inserts through its selected anchor guide to anchor the selected anchor stake to the perimeter frame 101. The plurality of anchor guides 104 comprises a first anchor guide 141, a second anchor guide 142, a third anchor guide 143, and a fourth anchor guide 144.

The first anchor guide 141 is an anchor guide selected from the plurality of anchor guides 104. The first anchor guide 141 is the anchor guide selected from the plurality of anchor guides 104 that has the least span of distance from the brink that is formed by the joining of the first perimeter plate 151 and the second perimeter plate 152.

The second anchor guide 142 is an anchor guide selected from the plurality of anchor guides 104. The second anchor guide 142 is the anchor guide selected from the plurality of anchor guides 104 that has the least span of distance from the brink that is formed by the joining of the second perimeter plate 152 and the third perimeter plate 153.

The third anchor guide 143 is an anchor guide selected from the plurality of anchor guides 104. The third anchor guide 143 is the anchor guide selected from the plurality of anchor guides 104 that has the least span of distance from the brink that is formed by the joining of the third perimeter plate 153 and the fourth perimeter plate 154.

The fourth anchor guide 144 is an anchor guide selected from the plurality of anchor guides 104. The fourth anchor guide 144 is the anchor guide selected from the plurality of anchor guides 104 that has the least span of distance from the brink that is formed by the joining of the fourth perimeter plate 154 and the first perimeter plate 151.

Each anchor stake selected from the plurality of anchor stakes 103 is a rigid structure. Each selected anchor stake has a composite prism shape. Each selected anchor stake is formed as a stake. The plurality of anchor stakes 103 form an anchor structure that anchors the perimeter frame 101 into the ground. The plurality of anchor stakes 103 hold the perimeter frame 101 in a fixed position relative to the ground. Each anchor stake selected from the plurality of anchor stakes 103 detachably attaches to the perimeter frame 101. Each selected anchor stake is driven into the ground such that the selected anchor stake anchors the perimeter frame 101 to the ground. The plurality of anchor stakes 103 comprises a first anchor stake 131, a second anchor stake 132, a third anchor stake 133, and a fourth anchor stake 134.

The first anchor stake 131 is the anchor stake selected from the plurality of anchor stakes 103 that anchors the first anchor guide 141 to the ground. The second anchor stake 132 is the anchor stake selected from the plurality of anchor stakes 103 that anchors the second anchor guide 142 to the ground. The third anchor stake 133 is the anchor stake selected from the plurality of anchor stakes 103 that anchors the third anchor guide 143 to the ground. The fourth anchor stake 134 is the anchor stake selected from the plurality of anchor stakes 103 that anchors the fourth anchor guide 144 to the ground.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Angle Plate and Bent Plate: As used in this disclosure, an angle plate is a rectangular plate that is bent to form a right angle such that the brink formed by the right angle runs parallel to the major axis of the rectangular plate. When formed from metal, an angle plate is often referred to as an angle iron. A bent plate is a rectangular plate that is bent to form a right angle such that the brink formed by the right angle runs parallel to the minor axis of the rectangular plate. When formed from metal, an angle plate is often referred to as an angle iron. The term punched (as in punched angle iron or punched bent plate) is taken to mean that a plurality of apertures that are formed through the faces of the rectangular plate that forms the plate structure. A punched plate is often called a perforated plate. Generally the center points of the plurality of apertures of a punched plate are aligned to be parallel to the major axis of the plate.

Anterior: As used in this disclosure, anterior is a term that is used to refer to the front side or direction of a structure. When comparing two objects, the anterior object is the object that is closer to the front of the structure.

Apex: As used in this disclosure, an apex is a vertex that forms an extreme or solitary point of an object.

Barrier: As used in this disclosure, a barrier is a physical obstacle that forms a boundary between a first space and a second space. The barrier prevents the passage of an object between the first space and the second space.

Boundary Structure: As used in this disclosure, a boundary structure is a barrier that separates a first object from a second object such that the second object cannot damage the first object.

Brick: As used in this disclosure, a brick is a rectangular block structure formed from a kiln dried clay. The brick is commonly used as a component in masonry projects. A brick can be formed from a synthetic clay.

Brink: As used in this disclosure, a brink refers to the edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Container: As used in this disclosure, a container is a structure that forms a protected space (or protection space) used to store and transport an object. The term containment structure is a synonym for container. Use protected space or protection space.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Earthwork: As used in this disclosure, earthworks refers to a process wherein: a) soil is removed or moved in preparation of another project; or, b) a man-made construction that incorporates the removed soil described in item (a) of this definition. A retaining wall is a type of earthwork.

Retaining Wall: As used in this disclosure, a retaining wall is an earthwork structure that separates the ground into two regions. The elevation of surface of the ground in the first region is different from the elevation of the ground in the second region. The retaining wall comprises a footing and a stem. The footing forms the structure that anchors the retaining wall to the ground. The stem is the vertically oriented boundary structure that divides the first region and the second region. The portion of the footing that extends beyond the stem into the region with the lower elevation is called the toe. The portion of the footing that extends beyond the stem into the region with the higher elevation is called the heel. The soil that elevates the surface of the region with the higher elevation is called the backfill.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Embankment: As used in this disclosure, an embankment is a constructed barrier that is formed as an earthwork. The embankment is typically used to control the flow of water.

Environment: As used in this disclosure, an environment refers to the physical conditions surrounding an object. The term environment is often limited to the physical conditions that the object interacts with.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Foundation: As used in this disclosure, a foundation is an earthwork structure that is formed to bear the load of a structure.

Framework: As used in this disclosure, a framework refers to a second object or structure that encloses a first object or structure.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is used as a relational term that implies that an object is contained within the boundary of a structure or a space.

Jig: As used in this disclosure, a jig is a device that is used for guiding a tool or for holding an object in place while it is being worked on by a tool or machine.

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior posterior axis. Lateral movement is often called sideways movement.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed from posterior side towards the anterior side. The right side of any object is the same side as the right side of the human body when the object is viewed from posterior side towards the anterior side. The left and right sides of the object remain unchanged by changes to the direction from which the object is viewed.

Level: As used in this disclosure, the verb to level means to modify the position of a surface relative to the force of gravity such that the surface forms a plane that is aligned: a) parallel to the horizontal direction; and, b) perpendicular to the vertical direction.

Leveling Device: As used in this disclosure, a leveling device is a tool used to identify a plane that is perpendicular to the force of gravity. The leveling device is a transparent cylindrical structure that contains a liquid phase media and a gas phase media. The plane that is perpendicular to the force of gravity is identified by the position of the gas phase media within the liquid phase media.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Major and Minor Axes: As used in this disclosure, the major and minor axes refer to a pair of perpendicular axes that are defined within a structure. The length of the major axis is always greater than or equal to the length of the minor axis. The major axis forms the longest symmetric bifurcation of a structure selected from the group consisting of: a) the structure; or, b) the perimetrical boundary of the structure. The major and minor axes intersect at the center of the structure. The major axis is always parallel or perpendicular to an edge of a rectangular or rectilinear structure.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term openwork is used to describe a structure, often a surface, which is formed with one or more openings that allow for visibility and fluid flow through the structure. Wrought work and meshes are forms of openwork.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Posterior: As used in this disclosure, posterior is a term that is used to refer to the side of an object that is distal or in the opposite direction of the anterior side. When comparing two items, the posterior item is the item that is distal from the anterior of the object.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Protection Space: As used in this disclosure, a protection space is a space formed by a boundary structure. The boundary structure forms a protective barrier that protects objects outside the protection space from potential dangers from the operation of a device or process contained within the protection space.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Rectangle: As used in this disclosure, a rectangle is an enclosed four sided geometric structure. Each angle formed by the rectangle is a right angle. A non-Euclidean rectangle is a rectangle that is formed on a non-Euclidean plane.

Rectangular Block: As used in this disclosure, a rectangular block refers to a three-dimensional prism structure comprising six rectangular surfaces (commonly called faces) formed at right angles. Within this disclosure, a rectangular block may further comprise rounded edges and corners.

Retaining Wall: As used in this disclosure, a retaining wall is an earthwork structure that separates the ground into two regions. The elevation of surface of the ground in the first region is different from the elevation of the ground in the second region. The retaining wall comprises a footing and a stem. The footing forms the structure that anchors the retaining wall to the ground. The stem is the vertically oriented boundary structure that divides the first region and the second region. The portion of the footing that extends beyond the stem into the region with the lower elevation is called the toe. The portion of the footing that extends beyond the stem into the region with the higher elevation is called the heel. The soil that elevates the surface of the region with the higher elevation is called the backfill.

Ring: As used in this disclosure, a ring is a term that is used to describe a disk-like structure through which a negative space is formed through the faces of the disk-like structure. Rings are often considered loops. The negative space formed through the faces of the disk-like structure is called the characteristic aperture. See Iris Structure Roughly: As used in this disclosure, roughly refers to a comparison between two objects. Roughly means that the difference between one or more parameters of the two compared objects are not significantly different.

Soil: As used in this disclosure, soil refers to the structure of the ground that forms the earth. The soil is organized into horizontal levels known as the top soil, subsoil, and bedrock. The top soil is the soil level with the highest elevation. The top soil is has a bulk solid structure that further contains a relatively high proportion of biologically generated material. The bedrock is the soil level with the lowest elevation. The bedrock is formed with a primarily rock structure. The bedrock forms a solid foundation which can reliably support structures. The subsoil is a layer of soil between the top soil and the bedrock. The subsoil has a bulk solid structure that further: a) has a lower proportion of biological material; and, b) has a higher density, or stated differently is more compressed than, the top soil.

Spit: As used in this disclosure, a spit refers to a composite prism structure formed by the combination of a prism and a pyramid such that the apex of the pyramid forms a point capable of pushing through the surface of a second structure.

Stake: As used in this disclosure, a stake is a stanchion that is driven into a horizontal surface, such as the ground, to serve as an anchor point. The stake is usually formed with a spit.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vertex: As used in this disclosure, a vertex (plural vertices) is an angle that is formed by two lines (or a plurality of surfaces) that form a point (or a brink). Vertices are commonly found in polygons, prisms and pyramids.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A ground leveling form comprising a perimeter frame, a plurality of angle plates, a plurality of anchor stakes, and a plurality of anchor guides;

wherein the plurality of anchor stakes attach to the perimeter frame;

wherein the plurality of anchor guides attach to the perimeter frame;

wherein the ground leveling form is a mechanical structure;

wherein the ground leveling form is a soil leveling structure;

wherein the plurality of anchor stakes anchors the ground leveling form to the ground;

wherein the perimeter frame has a rectangular shape;

wherein the plurality of angle plates comprises a first angle plate and a second angle plate;

wherein the first angle plate is the angle plate selected from the plurality of angle plates that attaches to a first perimeter plate;

wherein the first angle plate attaches to the interior lateral face of the first perimeter plate;

wherein the first angle plate attaches to the first perimeter plate such that the line of the bend formed in the first angle plate is parallel to the major axis of the first perimeter plate;

wherein the second angle plate is the angle plate selected from the plurality of angle plates that attaches to the second perimeter plate;

wherein the second angle plate attaches to the interior lateral face of the second perimeter plate;

wherein the second angle plate attaches to the second perimeter plate such that the line of the bend formed in the second angle plate is parallel to the major axis of the second perimeter plate;

wherein the plurality of perimeter plates comprises the first perimeter plate, the second perimeter plate, a third perimeter plate, and a fourth perimeter plate;

wherein the first perimeter plate is a rigid structure;

wherein the first perimeter plate forms a brink with the second perimeter plate;

wherein the first perimeter plate is the perimeter plate selected from the plurality of perimeter plates with a major axis that has the greatest span of length;

wherein the first perimeter plate attaches to the second perimeter plate such that a major axis of the first perimeter plate is perpendicular to a major axis of the second perimeter plate;

wherein the second perimeter plate is a rigid structure;

wherein the second perimeter plate forms a brink with the third perimeter plate;

wherein the second perimeter plate is the perimeter plate selected from the plurality of perimeter plates with a major axis that has a least span of length;

wherein the second perimeter plate attaches to the third perimeter plate such that a major axis of the second perimeter plate is perpendicular to a major axis of the third perimeter plate;

wherein the third perimeter plate is a rigid structure;

wherein the third perimeter plate forms a brink with the fourth perimeter plate;

wherein the third perimeter plate is the perimeter plate selected from the plurality of perimeter plates that is distal from the first perimeter plate;

wherein the third perimeter plate attaches to the fourth perimeter plate such that a major axis of the third perimeter plate is perpendicular to a major axis of the fourth perimeter plate;

wherein the fourth perimeter plate is a rigid structure;

wherein the fourth perimeter plate forms a brink with the first perimeter plate;

wherein the fourth perimeter plate is the perimeter plate selected from the plurality of perimeter plates that is distal from the second perimeter plate;

wherein the fourth perimeter plate attaches to the first perimeter plate such that a major axis of the fourth perimeter plate is perpendicular to a major axis of the first perimeter plate;

wherein the plurality of anchor guides comprises a first anchor guide, a second anchor guide, a third anchor guide, and a fourth anchor guide;

wherein the first anchor guide is an anchor guide selected from the plurality of anchor guides;

wherein the first anchor guide is the anchor guide selected from the plurality of anchor guides that has a least span of distance from the brink that is formed by joining of the first perimeter plate and the second perimeter plate;

wherein the second anchor guide is an anchor guide selected from the plurality of anchor guides;

wherein the second anchor guide is the anchor guide selected from the plurality of anchor guides that has a least span of distance from the brink that is formed by the joining of the second perimeter plate and the third perimeter plate;

wherein the third anchor guide is an anchor guide selected from the plurality of anchor guides;

wherein the third anchor guide is the anchor guide selected from the plurality of anchor guides that has a least span of distance from the brink that is formed by the joining of the third perimeter plate and the fourth perimeter plate;

wherein the fourth anchor guide is an anchor guide selected from the plurality of anchor guides;

wherein the fourth anchor guide is the anchor guide selected from the plurality of anchor guides that has a least span of distance from the brink that is formed by the joining of the fourth perimeter plate and the first perimeter plate.

2. The ground leveling form according to claim 1 wherein the perimeter frame is a jig;

wherein the perimeter frame is a ring shaped structure.

3. The ground leveling form according to claim 2 wherein the plurality of angle plates forms a bracing structure;

wherein the plurality of angle plates braces a plurality of bricks within a characteristic aperture;

wherein the plurality of angle plates holds the plurality of bricks in a final position after the elevation of the plurality of bricks have been set;

wherein each angle plate selected from the plurality of angle plates attaches to a perimeter plate selected from a plurality of perimeter plates;

wherein each selected angle plate attaches to perimeter plate selected from the group consisting of: a) the first perimeter plate; and, b) a third perimeter plate.

4. The ground leveling form according to claim 3 wherein the plurality of anchor guides form structures that secure the plurality of anchor stakes to the perimeter frame;

wherein each selected anchor guide is a hollow structure;

wherein each selected anchor guide is a tubular structure;

wherein a span of a length of an inner dimension of each selected anchor guide is greater than a span of a length of an outer dimension of any anchor stake selected from the plurality of anchor stakes;

wherein each selected anchor stake inserts through each selected anchor guide to anchor the selected anchor stake to the perimeter frame.

5. The ground leveling form according to claim 4 wherein each anchor stake selected from the plurality of anchor stakes is a rigid structure;

wherein each selected anchor stake is formed as a stake;

wherein the plurality of anchor stakes form an anchor structure that anchors the perimeter frame into the ground;

wherein the plurality of anchor stakes hold the perimeter frame in a fixed position relative to the ground;

wherein each anchor stake selected from the plurality of anchor stakes detachably attaches to the perimeter frame;

wherein each selected anchor stake is driven into the ground such that the selected anchor stake anchors the perimeter frame to the ground.

6. The ground leveling form according to claim 5 wherein the perimeter frame comprises a plurality of perimeter plates and a plurality of leveling devices;

wherein the plurality of perimeter plates forms the perimeter of the a structure of the perimeter frame;

wherein the plurality of perimeter plates are assembled to form a rectangular shape.

7. The ground leveling form according to claim 6 wherein each perimeter plate selected from the plurality of perimeter plates is a rigid structure;

wherein each selected perimeter plate is positioned such that a minor axis of the selected perimeter plate is parallel to the force of gravity;

wherein each selected perimeter plate is positioned such that a major axis of the selected perimeter plate is perpendicular to the force of gravity.

8. The ground leveling form according to claim 7 wherein each leveling device selected from the plurality of leveling devices is a leveling device;

wherein each selected leveling device is associated with a perimeter plate selected from the plurality of perimeter plates;

wherein each selected leveling device mounts on each selected leveling device associated selected perimeter plate such that the selected leveling device measures a cant between a major axis of the selected perimeter plate and the direction of the force of gravity.

9. The ground leveling form according to claim 8 wherein the plurality of leveling devices comprises a first leveling device, a second leveling device, a third leveling device, and a fourth leveling device;

wherein the first leveling device is the leveling device selected from the plurality of leveling devices that measures a cant between the force of gravity and a major axis of the first perimeter plate;

wherein the first leveling device mounts on a superior lateral face of the first perimeter plate;

wherein the second leveling device is the leveling device selected from the plurality of leveling devices that measures a cant between the force of gravity and a major axis of the second perimeter plate;

wherein the second leveling device mounts on a superior lateral face of the second perimeter plate;

wherein the third leveling device is the leveling device selected from the plurality of leveling devices that measures a cant between the force of gravity and a major axis of the third perimeter plate;

wherein the third leveling device mounts on a superior lateral face of the third perimeter plate;

wherein the fourth leveling device is the leveling device selected from the plurality of leveling devices that measures a cant between the force of gravity and a major axis of the fourth perimeter plate;

wherein the fourth leveling device mounts on a superior lateral face of the fourth perimeter plate.

10. The ground leveling form according to claim 9 wherein the plurality of anchor stakes comprises a first anchor stake, a second anchor stake, a third anchor stake, and a fourth anchor stake;

wherein the first anchor stake is the anchor stake selected from the plurality of anchor stakes that anchors the first anchor guide to the ground;

wherein the second anchor stake is the anchor stake selected from the plurality of anchor stakes that anchors the second anchor guide to the ground;

wherein the third anchor stake is the anchor stake selected from the plurality of anchor stakes that anchors the third anchor guide to the ground;

wherein the fourth anchor stake is the anchor stake selected from the plurality of anchor stakes that anchors the fourth anchor guide to the ground.

* * * * *